US007735246B2

(12) United States Patent
Kaskawitz

(10) Patent No.: US 7,735,246 B2
(45) Date of Patent: Jun. 15, 2010

(54) SNOWBLOWER CHUTE CONTROLS AND RELATED METHODS

(75) Inventor: Scott Kaskawitz, Burlington, NC (US)

(73) Assignee: Honda Motor Co., Ltd., Tokyo (JP)

( * ) Notice: Subject to any disclaimer, the term of this patent is extended or adjusted under 35 U.S.C. 154(b) by 150 days.

(21) Appl. No.: 12/045,382

(22) Filed: Mar. 10, 2008

(65) Prior Publication Data

US 2009/0223089 A1 Sep. 10, 2009

(51) Int. Cl.
*E01H 5/09* (2006.01)

(52) U.S. Cl. ..... 37/260

(58) Field of Classification Search ..... 37/244, 37/246, 248, 249, 254, 260, 262; 74/145, 74/473.33, 473.34; 180/9.21, 9.26, 9.28, 180/9.3

See application file for complete search history.

(56) References Cited

U.S. PATENT DOCUMENTS

| | | | | |
|---|---|---|---|---|
| 3,726,029 | A | 4/1973 | Deen et al. | |
| 3,742,626 | A | 7/1973 | Ellis | |
| 4,011,668 | A | 3/1977 | Gunderson | |
| 4,068,397 | A | 1/1978 | Bacon | |
| 4,072,359 | A | 2/1978 | Lillkvist | |
| 4,205,468 | A * | 6/1980 | Greider | 37/260 |
| 4,862,607 | A | 9/1989 | Wacker | |
| 5,438,770 | A * | 8/1995 | Miller | 37/227 |
| 5,444,927 | A | 8/1995 | Sosenko | |
| 5,735,064 | A * | 4/1998 | Holl | 37/260 |
| 6,499,238 | B2 | 12/2002 | Kluck et al. | |
| 6,502,335 | B2 | 1/2003 | Prochnow et al. | |
| 6,662,477 | B2 | 12/2003 | Dowe et al. | |
| 7,032,333 | B2 | 4/2006 | Friberg et al. | |
| 7,165,345 | B2 | 1/2007 | Beaudoin | |
| 7,194,827 | B2 | 3/2007 | Mercer et al. | |

* cited by examiner

*Primary Examiner*—Robert E Pezzuto
(74) *Attorney, Agent, or Firm*—Jenkins, Wilson, Taylor & Hunt, P.A.

(57) ABSTRACT

Snowblower chute controls and related methods are provided particularly suited for a snowblower. The snowblower chute controls can include a handle pivotably attached to a housing. The housing can have an interior wall with a linear or arcuate gear track. The handle can have a first end operably configured to a spool wheel by a pin. Also, a gear can be operably configured to the handle by the pin such that the gear engages the linear or arcuate gear track. First and second spool cables can have first and second ends, the first ends attached to the spool wheel and the second ends attached to a snowblower chute. The handle can be pivoted to cause the gear to move along the gear track and the spool wheel to rotate and spool the first and second spool cables, thereby rotating the snowblower chute.

21 Claims, 8 Drawing Sheets

SNOWBLOWER CHUTE CONTROLS AND RELATED METHODS

TECHNICAL FIELD

The subject matter described herein relates generally to control systems. More particularly, the subject matter disclosed herein relates to snowblower chute control systems and methods, particularly suitable for minimizing load and maximizing stroke for rotation of a snowblower chute.

BACKGROUND

When using a snowblower to remove snow, a user will often move in a first linear direction until reaching the end of some real or imaginary boundary. By doing so, the user throws snow in a consistent direction, usually to the side of the directional movement. After reaching the boundary, the user will turn the snowblower 180° and continue to remove snow by moving in a direction opposite of the first linear direction. During this return, the snow is thrown in a direction opposite that of when the user was moving in the first linear direction. As such, snow is thrown in areas that have already been passed over by the snowblower and were clear of snow. To prevent such problems, snowblowers often include means for rotating a snowblower chute so that snow can be thrown in a consistent direction no matter which direction the snowblower is being directed.

Typically, snowblower chute controls can be mechanical or electrical mechanisms. Mechanical controls can have a gear system in which a control handle is connected to the gear system for rotating the snowblower chute. A crank shaft, for example, can be used to transfer rotational motion from a shaft to a gear system that is directly configured to the snowblower chute for rotational movement. Electrical controls can typically include a joystick-type control handle that is mechanically linked to a gear system configured directly to the snowblower chute. Thus, movement of the joystick-type control handle imparts movement on the snowblower chute.

The mechanical controls often have high loads that require a significant amount of strength to operate. Furthermore, these mechanical controls have relatively complex configurations and most provide minimal stroke. When coupled with freezing temperatures, these mechanical systems can often be difficult to operate. Thus, it would be advantageous to have a less complex mechanical snowblower chute control system that minimizes load and maximizes stroke to facilitate ease of use when rotating a snowblower chute.

Therefore, improved snowblower chute controls are provided for maximizing stroke and maintaining minimal parts and load for a user during operation for reducing the difficulty in mechanically rotating a snowblower chute.

SUMMARY

In accordance with this disclosure, novel snowblower chute controls and methods are provided. It is therefore an object of the present disclosure to provide novel snowblower chute controls and methods that facilitate improved rotational control of a snowblower chute by maximizing stroke and minimizing load during operation. This and other objects as may become apparent from the present disclosure are achieved, at least in whole or in part, by the subject matter described herein.

BRIEF DESCRIPTION OF THE DRAWINGS

A full and enabling disclosure of the present subject matter including the best mode thereof to one of ordinary skill in the art is set forth more particularly in the remainder of the specification, including reference to the accompanying figures, in which.

DETAILED DESCRIPTION

Reference will now be made in detail to the description of the present subject matter, one or more examples of which are shown in the figures. Each example is provided to explain the subject matter and not as a limitation. In fact, features illustrated or described as part of one embodiment can be used in another embodiment to yield still a further embodiment. It is intended that the present subject matter cover such modifications and variations.

Figure 1:
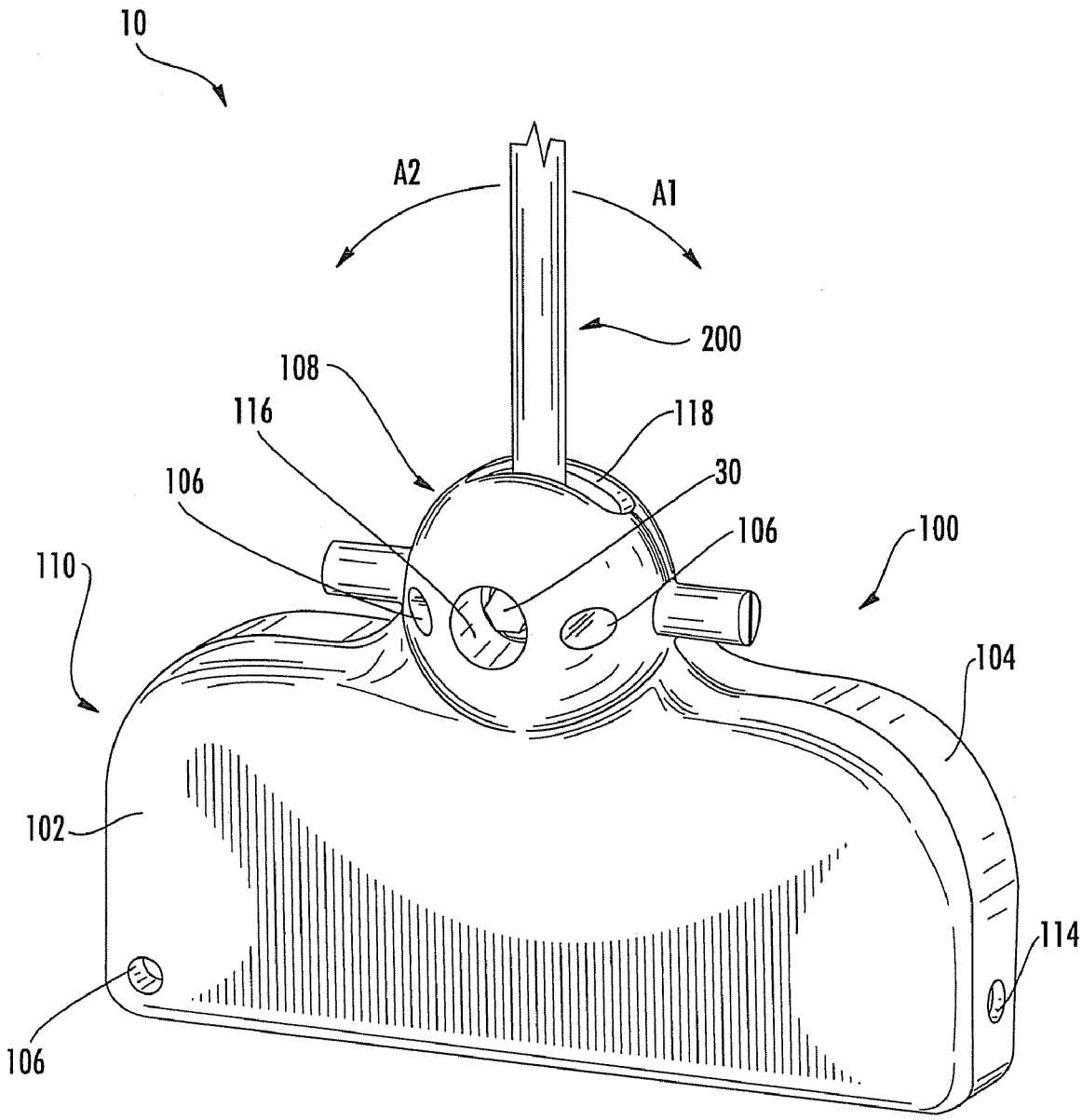
FIG. 1 illustrates a perspective view of an embodiment of a snowblower chute control according to the present subject matter.

FIG. 1 illustrates one aspect of a snowblower chute control, generally designated 10, in accordance with the present disclosure. Snowblower chute control 10 can be used to rotate a snowblower chute mounted on a snowblower. The snowblower chute can be rotated to advantageously change the direction in which snow is thrown from the snowblower. Snowblower chute control 10 can be attached to the snowblower such that a user can easily operate the snowblower chute control.

With further reference to FIG. 1, snowblower chute control 10 can include a housing, generally designated 100 in FIGS. 1-5, and a handle 200. Housing 100 can be generally constructed from a plastic material or any other suitable material. Housing 100 can comprise a first housing portion 102 and a second housing portion 104. First housing portion 102 and second housing portion 104 can be matingly configured such that the two form an enclosed area. First housing portion 102 and second housing portion 104 can define fastening apertures 106, which can receive fasteners such as screws to fasten first housing portion 102 and second housing portion 104.

Housing 100 can include a substantially spherical portion, generally designated 108, and a substantially rectangular portion, generally designated 110, wherein spherical portion 108 and rectangular portion 110 can be integral. Second housing portion 104 of housing 100 can define cable apertures such as cable aperture generally designated 114, and a pivot point aperture 116. Spherical portion 108 of housing 100 can define an arcuate handle slot 118, through which handle 200 can extend.

Snowblower chute control 10 can also include handle generally designated 200. Handle 200 can be substantially elongate and can be partially disposed within housing 100. Handle 200 can extend out of housing 100 through arcuate handle slot 118 of housing 100. Also, handle 200 can include a grip portion 202 to provide better gripping and handling by a user when moving handle 200. A bolt 30 can be used to pivotably attach handle 200 to housing 100. Bolt 30 can positioned within pivot point aperture 116 of spherical portion 108 of housing 100. Bolt 30 can pass through pivot point aperture 116 and handle 200 for attaching to housing 100. Handle 200 can be moved in direction A1 and direction A2 to effect rotation of the snowblower chute. Arcuate handle slot 118 permits the handle to move without butting against spherical portion 108 of housing 100.

In use, handle 200 can be gripped by a user at grip portion 202. The user can pull or push handle 200 in either direction A1 or direction A2. Movement of handle 200 in direction A1 can rotate the snowblower chute in a first rotational direction. Movement of handle 200 in direction A2 can rotate the snowblower chute in a second rotation direction that is opposite that of the first rotational direction. Handle 200 can either be fully moved in direction A1 or A2 such that handle 200 cannot move further, or handle 200 can be stopped at various intermediary positions to provide directional snow throwing at various angles as determined by the user. Such a configuration can provide less than 90° motion of the handle while requiring less than 3 kilograms load for operation. The details of such operations will be described in more detail below.

Figure 2:
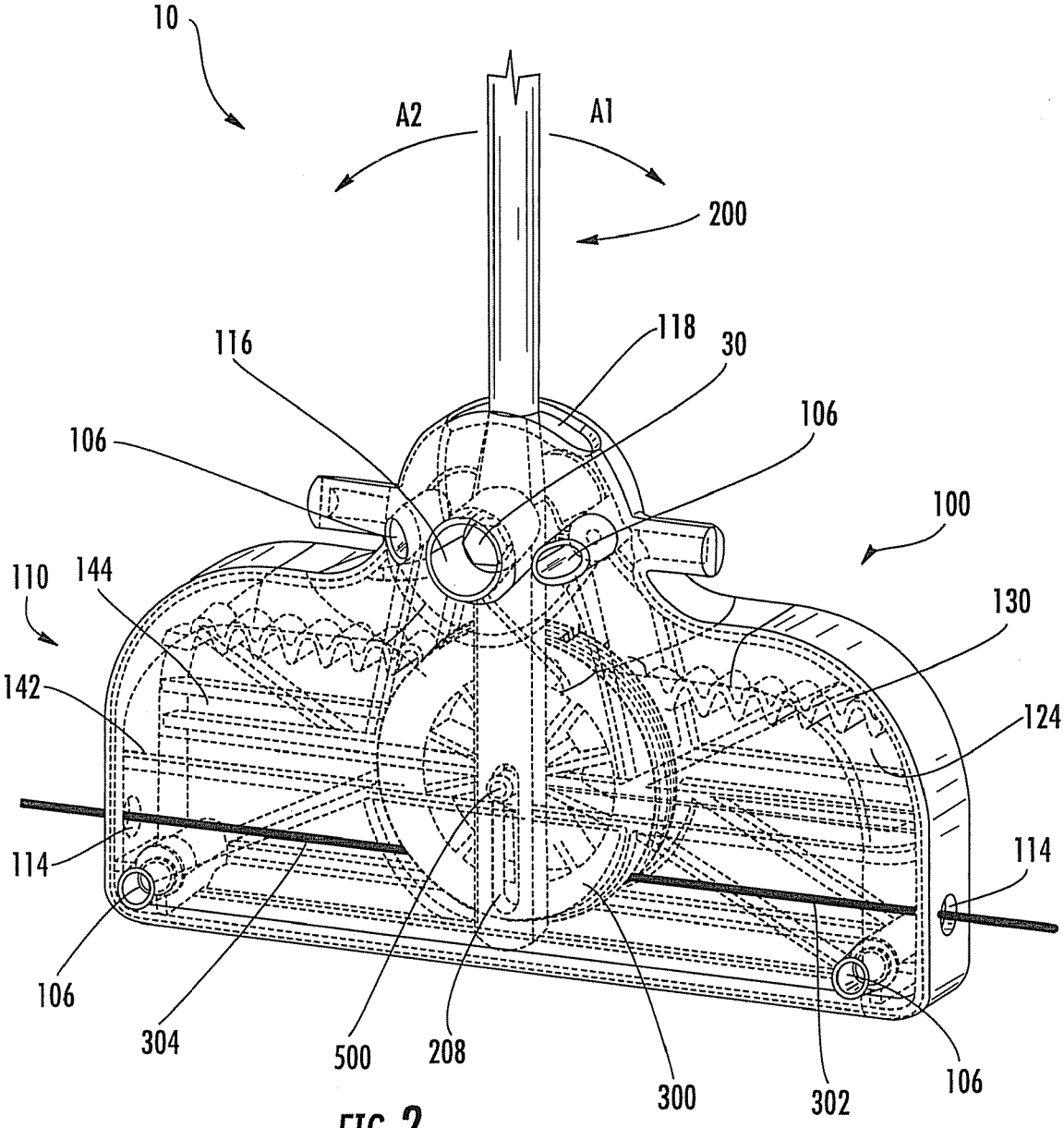
FIG. 2 illustrates a perspective view of the embodiment of the snowblower chute control according to FIG. 1 wherein the interior of the snowblower chute control is illustrated.
Figure 3:
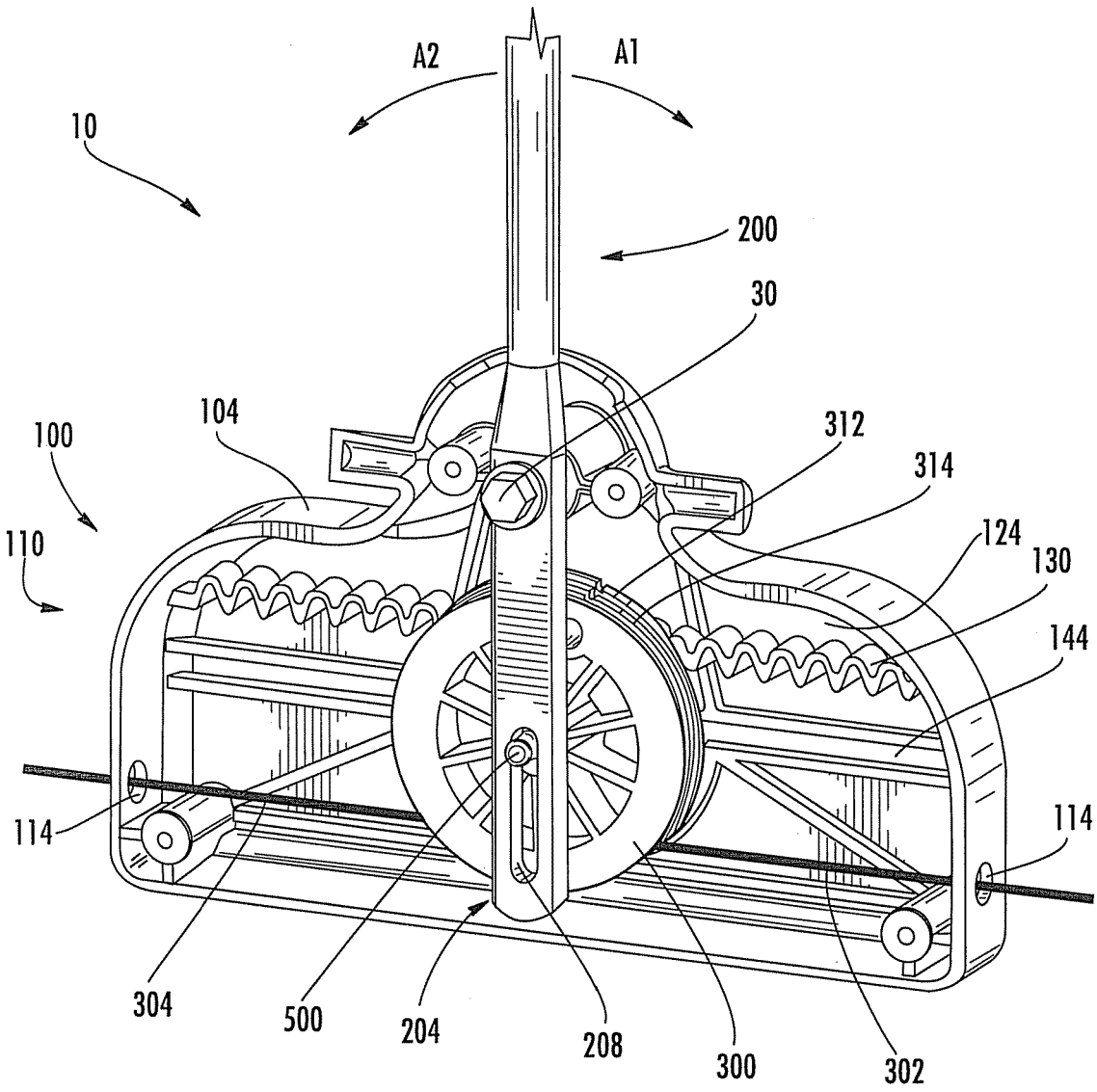
FIG. 3 illustrates a perspective view of the embodiment of the snowblower chute control according to FIG. 1 with portions removed to better illustrate the interior.
Figure 4:
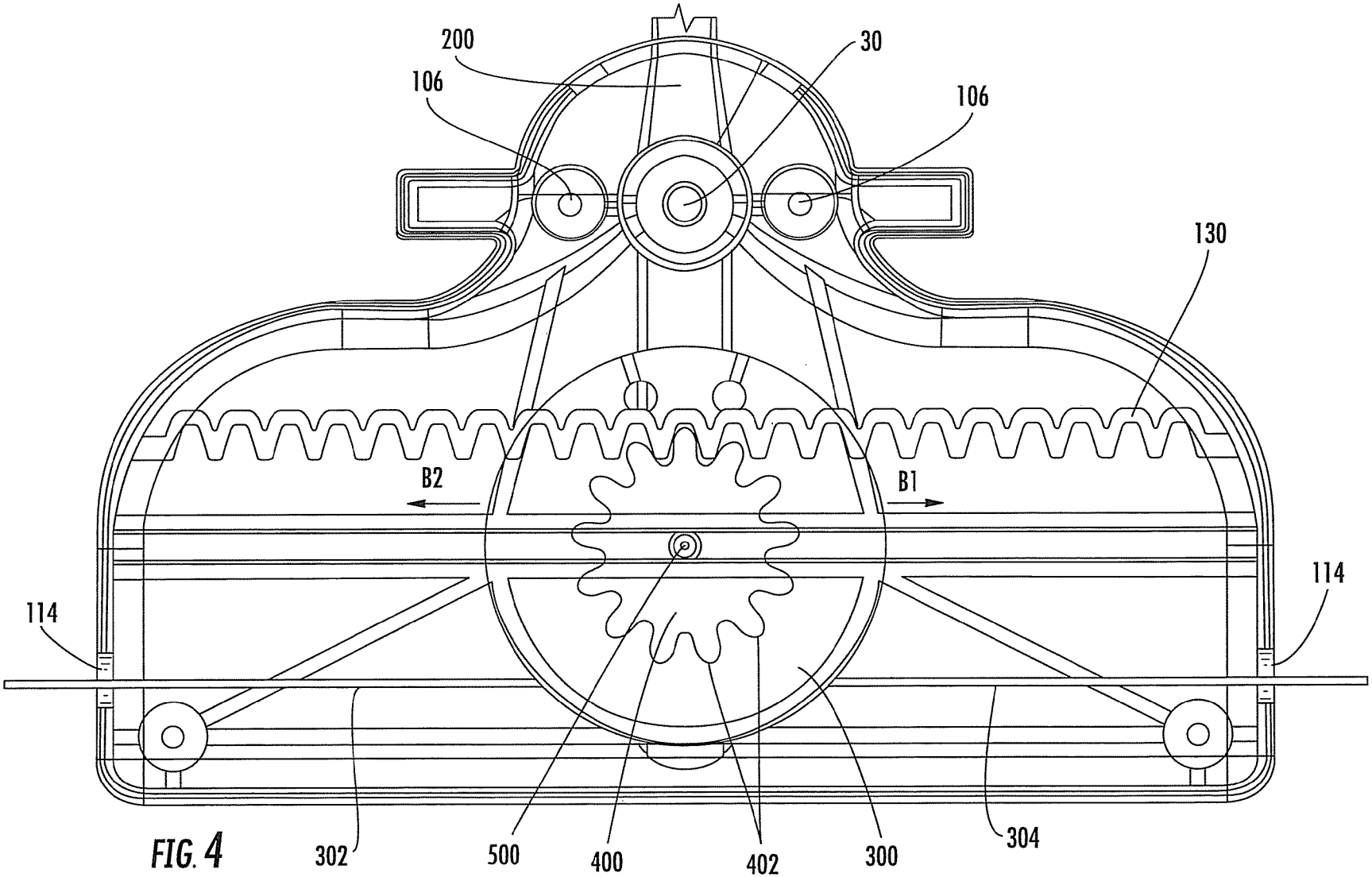
FIG. 4 illustrates a partial elevation cross-sectional view of the embodiment of the snowblower chute control according to FIG. 1.

FIGS. 2-4 illustrate the internal workings of snowblower chute control 10. Snowblower chute control 10 can further comprise a spool wheel 300, a first spool cable 302, a second spool cable 304, a gear 400 (FIG. 4), and a pin 500. In the embodiment shown in FIGS. 2-4, handle 200 can include a first end, generally designated 204, and a second end, generally designated 206. First end 204 of handle 200 can be disposed within housing 100 and can extend within rectangular portion 110. Second end 206 can extend out of housing 100 and can generally include grip portion 202. Handle 200 can define an elongate slot 208.

Figure 5:
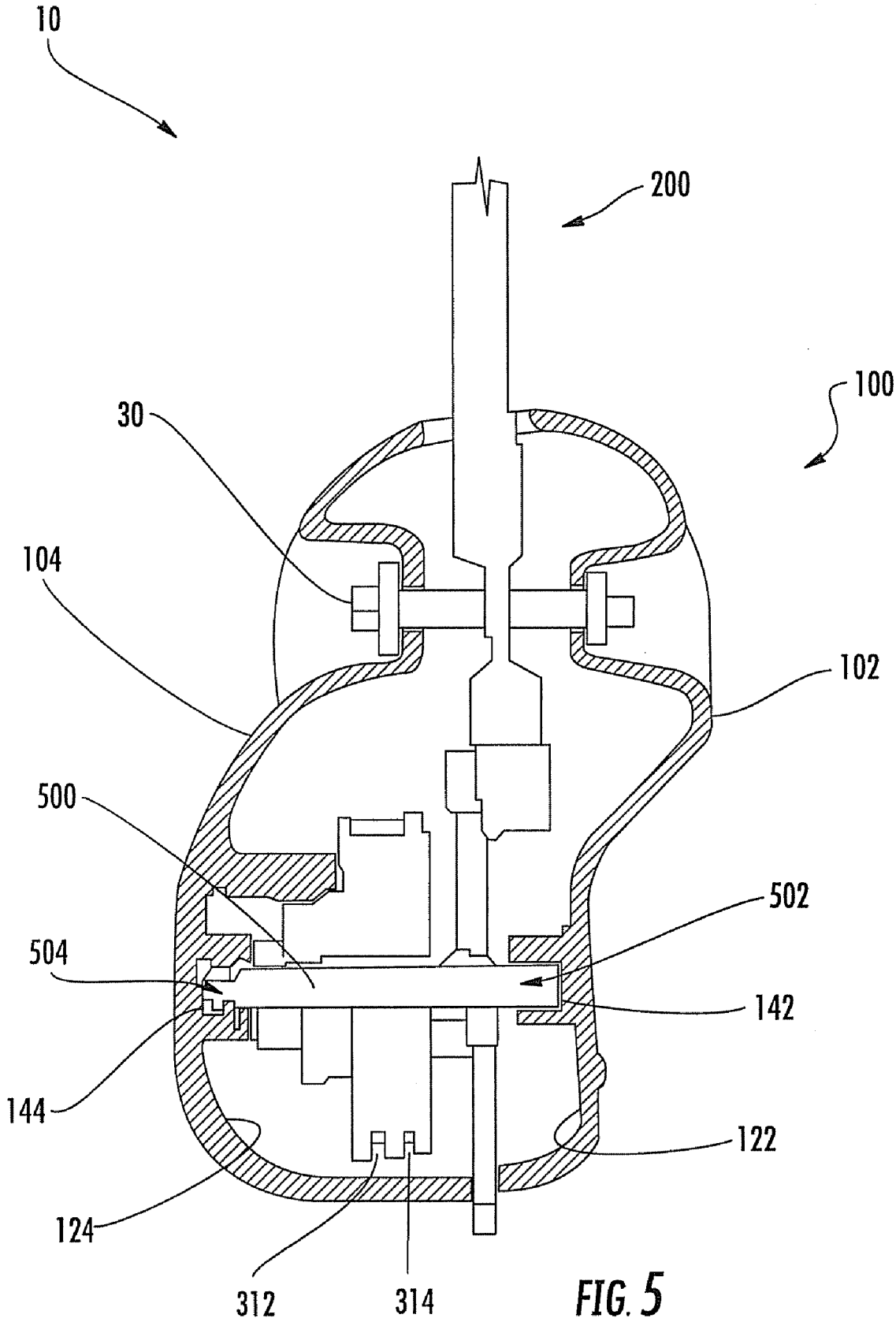
FIG. 5 illustrates a cross-sectional end view of the embodiment of the snowblower chute control according to FIG. 1.

First housing portion 102 of housing 100 can include a first interior wall 122 (shown in FIG. 5). Second housing portion 104 of housing 100 can include a second interior wall 124. Second interior wall 124 of second housing portion 104 of housing 100 can be molded to define a gear track 130. In this particular aspect, gear track 130 can be substantially linear and can be configured to mesh with gear 400. First interior wall 122 of first housing portion 102 of housing 100 can define a first pin track, generally designated 142, that can be substantially linear. Second interior wall 124 of second housing portion 104 of housing 100 can define a second pin track, generally designated 144, that can also be substantially linear.

Spool wheel 300 can be operably configured to handle 200 by pin 500. As shown in FIG. 3, spool wheel 300 can define a first channel 312, and a second channel 314. First spool cable 302 can be attached to spool wheel 300 and can be disposed within first channel 312 such that when spool wheel 300 is rotated, first spool cable 302 can be received and wound within first channel 312. Second spool cable 304 can be attached to spool wheel 300 and can be disposed within second channel 314 such that when spool wheel 300 is rotated, second spool cable 304 can be received and wound within second channel 314. First spool cable 302 and second spool cable 304 can extend out of housing 100 through cable apertures 114 of second housing portion 104. The ends of first and second spool cables 302 and 304 that are not attached to spool wheel 300 can be attached to the snowblower and configured to effect rotation of snowblower chute when wound around spool wheel 300.

As shown in FIG. 4, gear 400 can be operably configured to handle 200 by pin 500. Gear 400 can have gear teeth such as teeth 402 that can meshingly engage gear track 130 of second housing portion 104 of housing 100. In this aspect, gear track 130 is substantially linear such that gear 400 can move in a substantially linear path.

As shown in FIG. 5, pin 500 can be disposed within elongate slot 208 (FIG. 3) of handle 200, spool wheel 300, and gear 400. Pin 500 can comprise a first end, generally designated 502, and a second end, generally designated 504. First end 502 of pin 500 can be positioned within first pin track 142 (FIG. 2) such that first end 502 of pin 500 can rest within first pin track 142 to maintain a substantially linear path during movement. Second end 504 of pin 500 can be positioned within second pin track 144 such that second end 504 of pin 500 can rest within second pin track 144 to maintain a substantially linear path during movement. Also, pin 500 can move within elongate slot 208 of handle 200 during movement of handle 200 in directions A1 and A2 (FIG. 3).

In use, the user can pivot handle 200 in either direction A1 or A2 to rotate the snowblower chute, depending on which direction the user wants snow thrown. When moved in direction A1, handle 200 can pivot on bolt 30 to thereby cause first end 204 of handle 200 to move in direction B1 (FIG. 4) opposite that of direction A1. Movement of first end 204 of handle 200 can cause pin 500 to move linearly in direction B1 within first pin track 142 and second pin track 144 such that first end 502 of pin 500 can slidably move within elongate slot 208 of handle 200. Directional movement of pin 500 can cause spool wheel 300 and gear 400 to rotate and move in direction B1. Spool wheel 300 can rotate in direction B1 such that first spool cable 302 can be spooled around spool wheel 300 within first channel 312 of spool wheel 300. The end of first spool cable 302 attached to the snowblower chute can be pulled to cause the snowblower chute to rotate. Gear track 130 can permit handle 200 to be pulled to numerous positions and locked therein by the engagement of gear teeth 402 with gear track 130 such that various angles of directional snow throwing can be achieved.

When moved in direction A2, handle 200 can pivot on bolt 30 to thereby cause first end 204 of handle 200 to move in direction B2 opposite that of direction A2. As such, pin 500 can move linearly in direction B2 and can operate in the same manner as described above. However, in this instance spool wheel 300 can rotate and move in direction B2 such that second spool cable 304 can be spooled around spool wheel 300 within second channel 314 of spool wheel 300. The end of second spool cable 304 attached to the snowblower chute can be pulled to cause the snowblower chute to rotate.

Figure 6:
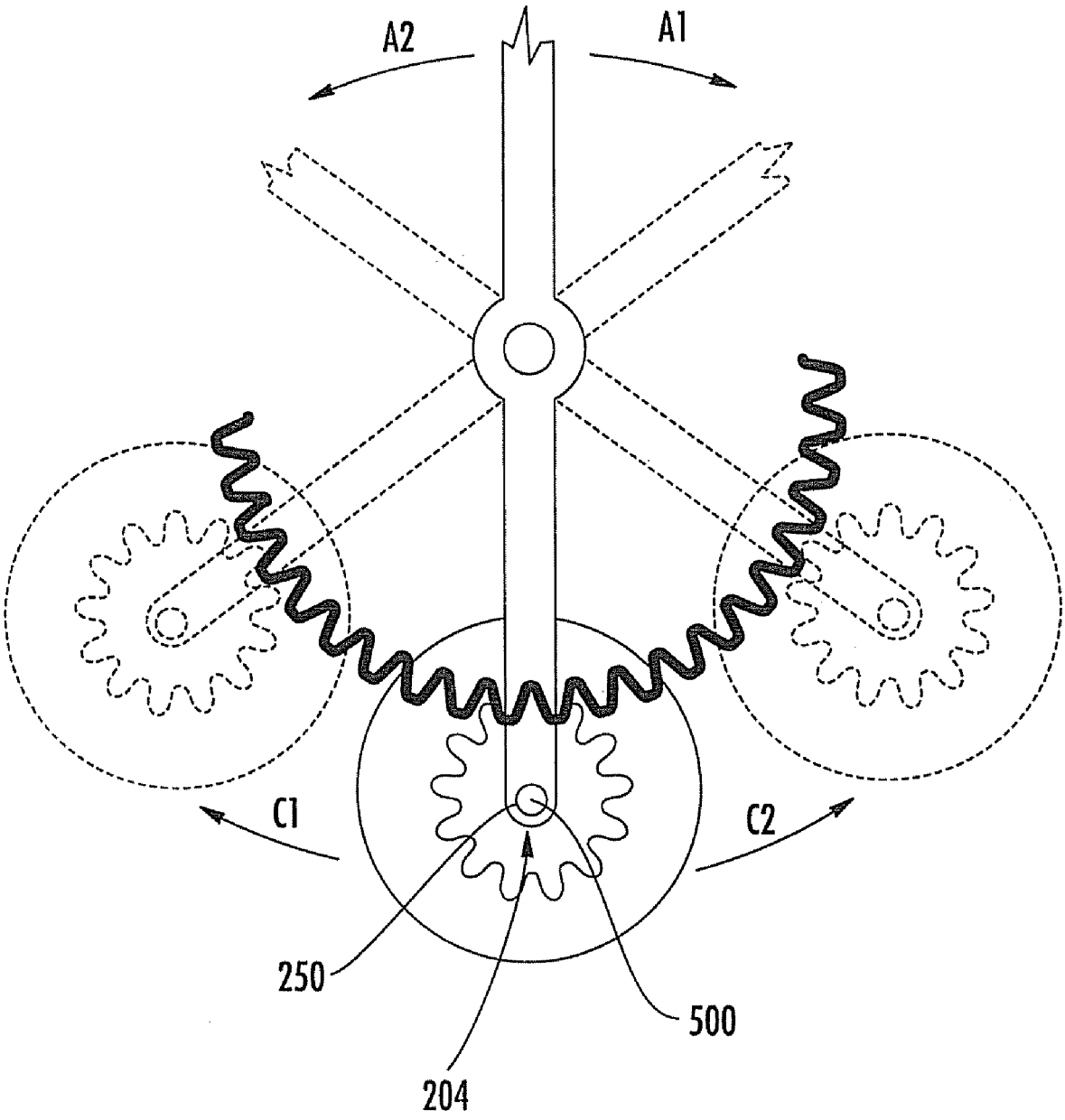
FIG. 6 illustrates a side view of a gear moving along a substantially arcuate gear track in an alternate embodiment of the snowblower chute control according to the present subject matter.

In another aspect of the present disclosure, as illustrated in FIG. 6, gear track 130 of second housing portion 104 of housing 100 can be substantially arcuate. In this aspect, pin 500 will not be confined to linearly shaped first and second pin tracks 142 and 144. However, first and second pin tracks 142 and 144 can correspondingly be substantially arcuate. Handle 200 can have a pin aperture, generally designated 250, that can receive pin 500. Such a configuration can provide a more simple construction, but can provide slightly less stroke.

In use, handle 200 can be moved in direction A1, thereby causing first end 204 of handle 200 to move in arcuate path C1. Additionally, spool wheel 300 and gear 400 can also move along arcuate path C1. Gear 400 can rotate such that gear teeth 402 follow gear track 130. Furthermore, spool wheel 300 can rotate such that first spool cable 302 can be wound about spool wheel 300 to effect rotation of the snowblower chute. Handle 200 can be moved in direction A2, thereby causing first end 204 of handle 200 to move in arcuate path C2. Additionally, spool wheel 300 and gear 400 can also move along arcuate path C2. As such, spool wheel 300 can rotate such that second spool cable 304 can be wound about spool wheel 300 to effect rotation of the snowblower in a direction opposite of that which occurs when handle 200 is moved in direction A1.

Figure 7:
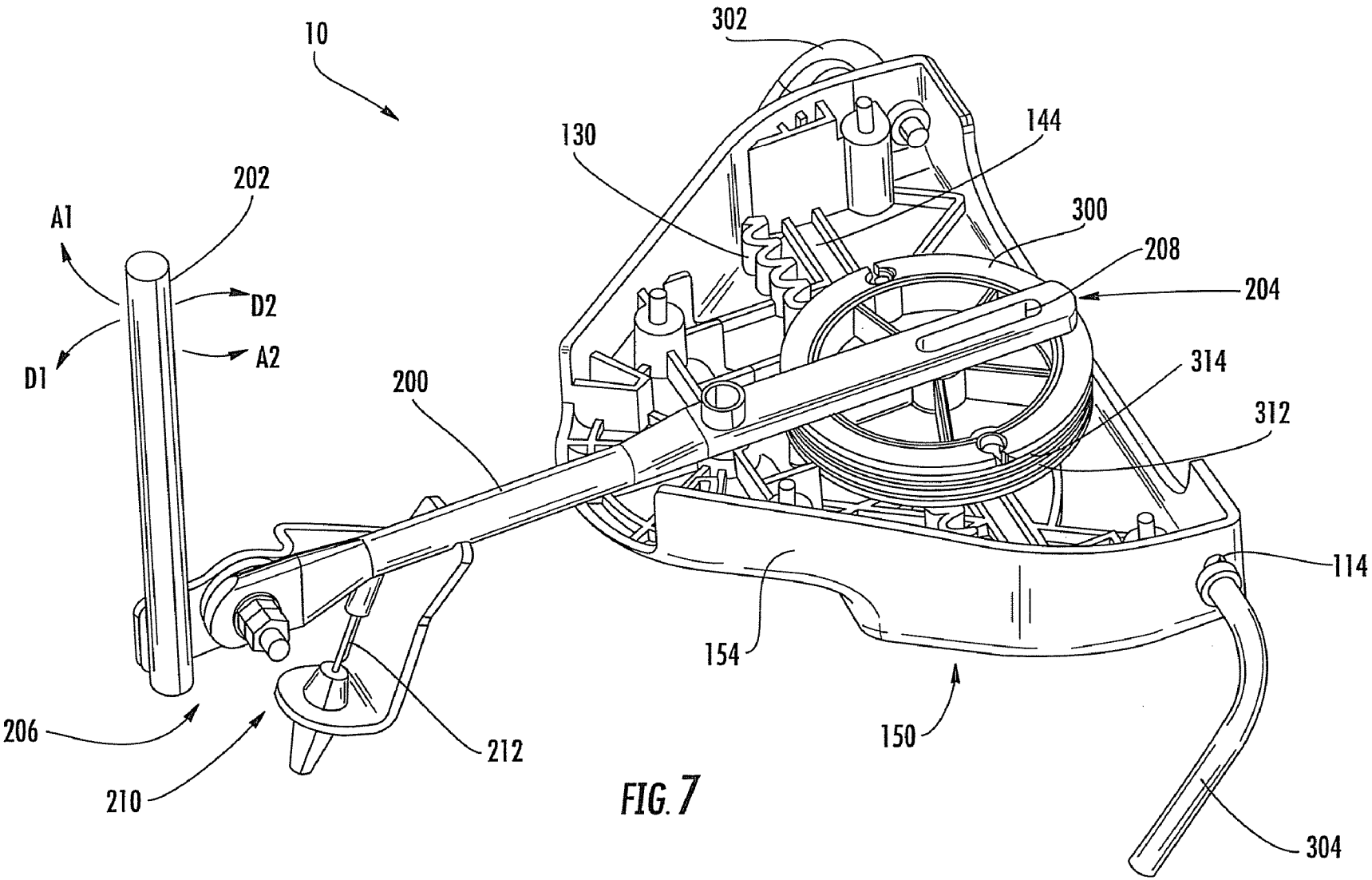
FIG. 7 illustrates a perspective view of another embodiment of a snowblower chute control according to the present subject matter with portions removed to better illustrate the interior.
Figure 8:
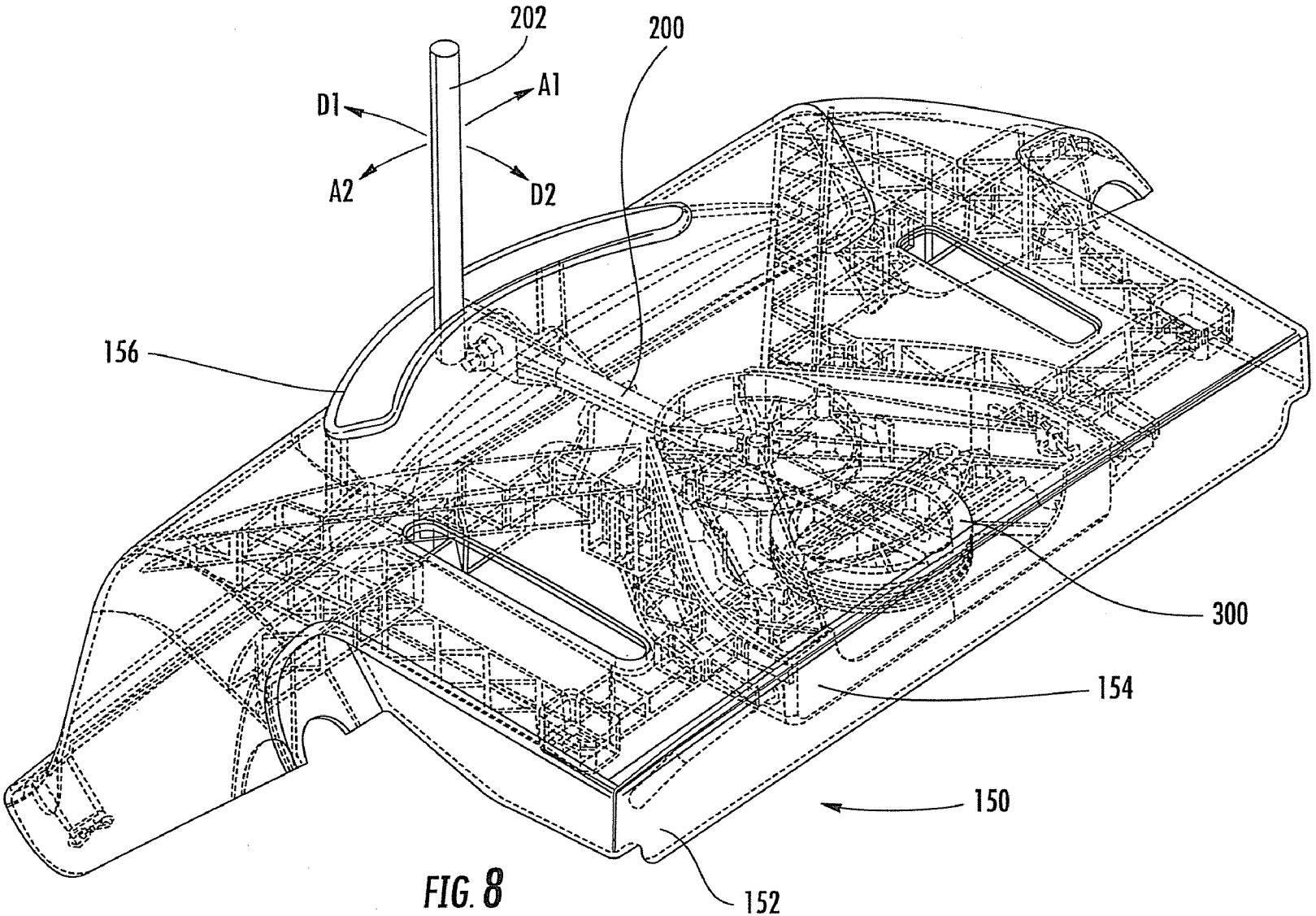
FIG. 8 illustrates a perspective view of the embodiment of the snowblower chute control according to FIG. 7 within a snowblower housing.

Yet another aspect of the present disclosure, illustrated in FIGS. 7 and 8, provides a different configuration of snowblower chute control 10. Similar to the previous configuration, snowblower chute control 10 can include a housing, generally designated 150 in FIGS. 7 and 8, a handle 200, and a spool wheel 300. Housing 150 can comprise a first housing portion 152 (shown in FIG. 8) and a second housing portion 154. Handle 200 can be pivotally connected to spool wheel 300 within an enclosed area formed by first housing portion 152 and second housing portion 154. First housing portion 152 can include an arcuate handle slot 156, as shown in FIG. 8, through which grip portion 202 of handle 200 can extend. The operation of handle 200 in combination with spool wheel 300 can be as described above with respect to the previous configuration of snowblower chute control 10, wherein handle 200 can be pivotably moved in either direction A1 or A2 to rotate the snowblower chute.

Snowblower chute control 10 according to this configuration can further include a discharge deflector control generally designated 210. As shown in FIG. 7, grip portion 202 can be pivotally connected to handle 200 at its second end 206. For example, grip portion 202 can be connected to handle 200 using friction washers. Discharge deflector control 210 can be coupled to grip portion 202 such that pivoting movement of grip portion 202 relative to handle 200 allows the user to adjust the trajectory of the snow discharged from the snowblower chute.

In particular, discharge deflector control 210 can include a wire 212 (e.g., a Bowden wire) connecting discharge deflector control 210 to a discharge deflector pivotally connected to the outlet end of the snowblower chute. In this arrangement, operation of discharge deflector control 210 causing extension or retraction of wire 212 changes the tilt of the discharge deflector relative to the snowblower chute. Specifically, if grip portion 202 is tilted in direction D1, the discharge deflector can be tilted down, resulting in snow being discharged from the snowblower chute in a low trajectory. Alternatively, if grip portion 202 is tilted in direction D2, the discharge deflector can be tilted up, resulting in show being discharged from the snowblower chute in a high trajectory. This configuration of snowblower chute control 10 thus provides multi-directional control over the snowblower chute through the operation of a single handle.

Embodiments of the present disclosure shown in the drawings and described above are exemplary of numerous embodiments that can be made within the scope of the appending claims. It is contemplated that the configurations described herein can comprise numerous configurations other than those specifically disclosed. The scope of a patent issuing from this disclosure will be defined by these appending claims.

What is claimed is:

1. A snowblower chute control comprising:

a housing having an interior wall and a gear track within the housing;

a handle partially disposed within the housing;

a gear having gear teeth for engaging the gear track of the housing and the gear being operatively attached to the handle;

a spool wheel for attachment to first and second spool cables, the spool wheel being operatively attached to the gear for rotation therewith; and wherein the handle is configured for movement to cause translational movement of the gear and spool wheel such that the first spool cable and the second spool cable spool about the spool wheel to rotate a snowblower chute.

2. The snowblower chute control according to claim 1, wherein the gear track is disposed along a substantially linear path.

3. The snowblower chute control according to claim 1, wherein the gear track is disposed along a substantially arcuate path.

4. The snowblower chute control according to claim 1, wherein the handle has a first end and a second end, the first end being disposed within the housing and defining an elongate slot.

5. The snowblower chute control according to claim 4, wherein the second end of the handle extends out of the housing and includes a grip portion for a user to grab to move the handle.

6. The snowblower chute control according to claim 5, further comprising:

a discharge deflector pivotally attached to an outlet end of the snowblower chute; and a discharge deflector control coupled to the grip portion;

wherein the grip portion is pivotally connected to the handle such that pivoting movement of the grip portion relative to the handle operates the discharge deflector control to pivot the discharge deflector.

7. The snowblower chute control according to claim 4, further comprising a pin that extends through the gear, the spool wheel, and the elongate slot of the handle.

8. The snowblower chute control according to claim 7, configured such that movement of the handle can cause the pin to slide within the elongate slot of the handle and thereby rotate the spool wheel and the gear along the gear track.

9. The snowblower chute control according to claim 1, wherein the handle has a first end and a second end, the first end being disposed within the housing and defining a pin aperture.

10. The snowblower chute control according to claim 9, further comprising a pin that extends through the gear, the spool wheel, and the pin aperture of the handle.

11. The snowblower chute control according to claim 10, configured such that a pivoting motion of the handle can cause the first end of the handle to move in an arcuate path such that the spool wheel and the gear move in an arcuate path and thereby rotate the spool wheel to spool the first and second spool cables about the spool wheel to rotate the snowblower chute.

12. The snowblower chute control according to claim 1, wherein the spool wheel defines a first channel and a second channel, the first channel receiving the first spool cable and the second channel receiving the second spool cable.

13. The snowblower chute control according to claim 1, wherein the housing further comprises an attachment portion for attaching the housing to a snowblower.

14. The snowblower chute control according to claim 1, wherein the handle is pivotably attached to the housing by a bolt.

15. The snowblower chute control according to claim 1, wherein the housing comprises a first housing portion and a second housing portion.

16. A snowblower chute control comprising:

a housing having a substantially rectangular portion and a substantially spherical portion defining an arcuate handle slot, the housing further having an interior wall wherein the interior wall of the housing defines a linear gear track and a linear pin track;

a handle having a first end disposed within the housing and defining an elongate slot, the handle further having a second end extending out of the housing through the arcuate handle slot of the housing, wherein the handle is pivotably connected to the housing within the spherical portion;

a pin having a first end and a second end being positioned within the linear pin track of the housing, the first end of the pin being positioned within the elongate slot of the first end of the handle;

a spool wheel operatively attached to the handle by the pin, the spool wheel defining a first channel and a second channel;

a first spool cable disposed within the first channel of the spool wheel, the first spool cable having a first end attached to the spool wheel and a second end attached to a snowblower chute;

a second spool cable disposed within the second channel of the spool wheel, the second spool cable having a first end attached to the spool wheel and a second end attached to the snowblower chute;

a gear having gear teeth engaging the linear gear track of the housing and the gear being operatively attached to the handle by the pin; and wherein the handle is configured to pivot and cause the pin to move within the elongate slot of the first end of the handle to rotate the spool wheel and the gear in a linear direction, to thereby spool the first spool cable and the second spool cable around the spool wheel to rotate the snowblower chute.

17. A snowblower chute control comprising:

a housing defining a handle slot, and the housing having an interior wall wherein the interior wall of the housing defines a substantially arcuate gear track;

a handle having a first end disposed within the housing and defining a pin aperture, the handle further having a second end extending out of the housing through the handle slot of the housing, wherein the handle is pivotably connected to the housing;

a pin having a first end and a second end, the first end of the pin being positioned within the pin aperture of the first end of the handle;

a spool wheel operably configured to the handle by the pin, the spool wheel defining a first channel and a second channel;

a first spool cable disposed within the first channel of the spool wheel, the first spool cable having a first end attached to the spool wheel and a second end attached to a snowblower chute;

a second spool cable disposed within the second channel of the spool wheel, the second spool cable having a first end attached to the spool wheel and a second end attached to the snowblower chute;

a gear having gear teeth engaging the substantially arcuate gear track of the housing and the gear being operably configured to the handle by the pin; and wherein the handle is configured to pivot to cause the pin to move in an arcuate path within the housing to rotate the spool wheel and move the gear along the arcuate gear track in an arcuate direction, to thereby spool the first spool cable and the second spool cable around the spool wheel to rotate the snowblower chute.

18. A method for rotating a snowblower chute, the method comprising:

providing a snowblower chute control comprising:

a housing defining a gear track;

a handle partially disposed within the housing;

a gear having gear teeth engaging the gear track of the housing and the gear being operatively attached to the handle; and a spool wheel having a first spool cable and a second spool cable attached thereto and the spool wheel being operatively attached to the gear for rotation therewith;

moving the handle in a first direction to rotatably drive the gear teeth of the gear along the gear track of the housing, whereby rotation of the gear causes rotation of the spool wheel; and winding the first spool cable and the second spool cable about the spool wheel to rotate a snowblower chute in a first rotational direction.

19. The method according to claim 18, further comprising moving the handle in a second direction to rotate the snowblower chute in a second rotational direction.

20. The method according to claim 18, wherein the step of rotatably driving the gear teeth of the gear along the gear track of the housing includes moving the gear in a substantially linear path along the gear track.

21. The method according to claim 18, wherein the step of rotatably driving the gear teeth of the gear along the gear track of the housing includes moving the gear in a substantially arcuate path along the gear track.

* * * * *